United States Patent [19]

O'Mara et al.

[11] Patent Number: 4,693,091

[45] Date of Patent: Sep. 15, 1987

[54] CONDENSATE DISPOSAL SYSTEM

[75] Inventors: Raymond D. O'Mara, Mallory; Ian M. Shapiro, Syracuse, both of N.Y.

[73] Assignee: Carrier Corporation, Syracuse, N.Y.

[21] Appl. No.: 864,354

[22] Filed: May 19, 1986

[51] Int. Cl.[4] ..... F25D 21/00

[52] U.S. Cl. ..... 62/272; 137/59; 62/80

[58] Field of Search ..... 62/272, 285, 80; 137/59, 60, 61, 62

[56] References Cited

U.S. PATENT DOCUMENTS 4,462,216 7/1984 Kramer ..... 62/272

*Primary Examiner*—Henry A. Bennet

*Attorney, Agent, or Firm*—Dana F. Bigelow

[57] ABSTRACT

In an air conditioning system having a condensate tube interconnecting a condensate pan and a trap, a vent is provided in the condensate tube for relieving any internal pressure which would otherwise cause a restriction of condensate flow within the condensate tube.

7 Claims, 3 Drawing Figures

CONDENSATE DISPOSAL SYSTEM

BACKGROUND OF THE INVENTION

This invention relates generally to air conditioning equipment and more particularly to apparatus for draining the condensate from a condensate pan associated with the fan coil of an air conditioning system.

In the normal operation of an air conditioning system, the evaporator or fan coil tends to be at temperatures below the dew point of the surrounding air. The resulting condensation is collected in a pan located under the coil, with the pan then being drained off to an appropriate disposal site such as a sewer drain or to the ground outside.

Because of a low pressure condition that is created by the operation of the fan inside the unit, it has become conventional practice to provide a P-trap to prevent the inward flow of air through the drainage pipe, which flow of air would otherwise tend to prevent the flow of condensate from the condensate pan. In addition, the P-trap acts to isolate the system from the backflow of odors that would otherwise occur when the system is connected to discharge condensate directly to the sewer.

In some air conditioning systems it is not convenient to locate the evaporator coil near the P-trap, which is conventionally located just outside the cabinet. For example, in a packaged system, wherein both the outdoor and the indoor sections are located within a single cabinet, in order to accommodate all of the necessary components within the cabinet, it may be desirable to locate the evaporator coil and associated condensate pan at some distance from the cabinet panel. The pan is then commonly interconnected to the P-trap by way of a condensate hose that runs substantially horizontally between the two components. With the use of such a condensate hose, it has been found that, under certain operating conditions, the condensate will not flow through the length of the condensate hose and will therefore accumulate in the condensate pan to the point where the pan will overflow and wet the insulation material therebelow and eventually cause damage to the insulation and loss of efficiency in the system. For example, it has been found that with the use of a large blower that produces high static pressures, the negative pressures surrounding the coil tend to prevent the condensate from flowing through the entire length of the condensate hose to the P-trap. Similarly, it has been found that resistance to flow is also caused by water turbulence in the condensate pan as occurs by the fan-created air motion above the pan. It has also been observed by the inventors that the resistance to flow within the condensate hose may be affected by other things such as the close proximity of the coil itself to the discharge drain in the condensate pan or a partial restriction at the entrance of the condensate hose.

In all such cases, the ultimate cause of the failure of condensate to drain from the condensate pan is seen by the inventors to be the trapping of a volume of air between the flow of water from the pan and the P-trap.

It is therefore an object of the present invention to provide an improved condensate disposal system for an air conditioning apparatus.

Another object of the present invention is the provision in an air conditioning system for ensuring proper condensate drainage under all operating conditions.

Yet another object of the present invention is the provision for ensuring the proper flow of condensate through a condensate hose connecting a condensate pan and a P-trap.

Still another object of the present invention is a provision for a condensate disposal system which is economical to manufacture and effective in use.

These objects and those other features and advantages become more readily apparent upon reference to the following description when taken in conjunction with the appended drawings.

SUMMARY OF THE INVENTION

Briefly, in accordance with one aspect of the invention, an air vent is placed in the condensate hose, such that the air bubble that would otherwise be trapped between the water in the P-trap and the water flowing from the condensate pan, can be bled off into the surrounding negative pressure environment to thereby allow the flow of condensate through the condensate hose. In this way, buildup of condensate within the condensate pan is avoided to thereby prevent any overflow that would otherwise result in damage to the system.

In accordance with another aspect of the invention, the vent is located at the downstream end of the condensate hose, as near as possible to the P-trap, to thereby obtain the full benefit of its use. Thus, if, for the reasons discussed hereinabove, the air in the condensate hose does not escape at the entrance end where the hose connects to the condensate pan, the vent will relieve the trapped air to thereby allow the water to travel along the length of the hose.

But, yet, another aspect of the invention, a vertically extending riser is connected to the vent. This riser is preferably made of a material which is not easily deformed (e.g. copper) such that the shape of the vent hole will be maintained and will not tend to close or plug up with time. Further, the riser is preferably of a length that extends above the height of the sides of the condensate pan such that no matter what the depth of the condensate in the condensate pan, it will not tend to run out of the riser tube.

In the drawings as hereinafter described, a preferred embodiment is depicted; however, various other modifications and constructions can be made thereto without departing from the true spirit and scope of the invention.

DESCRIPTION OF THE PREFERRED EMBODIMENT

Figure 1:
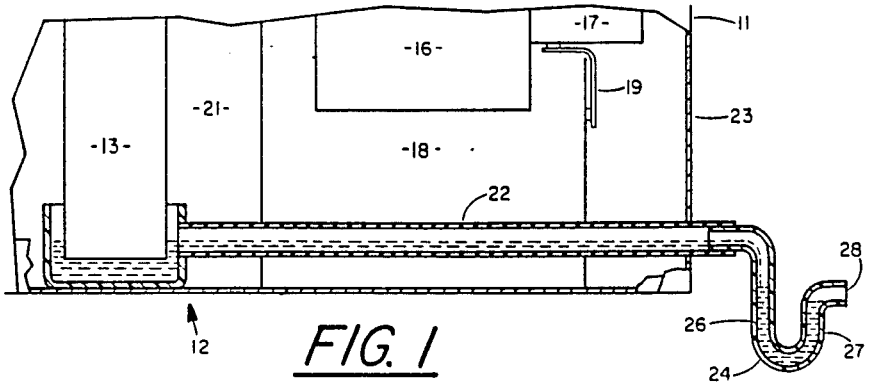
FIG. 1 is a side view of a heat pump with portion broken away to show the condensate drainage system thereof.

Referring now to FIG. 1, there is shown a cabinet 11 containing a drainage system 12 of the type with which the present invention is adaptable for use.

The cabinet 11 contains an evaporator coil 13 with an associated condensate pan 14 mounted therebelow for collecting and disposing of any condensate which tends to form on and then drip off of the coil 13.

Also located in the cabinet 11 is a blower wheel 16 and driving motor 17. The blower wheel 16 and the motor 17 are concentrically mounted within the blower housing 18 by way of the mounting brackets 19. The blower assembly is thus situated within the cabinet 11 in such a way that the blower wheel draws the air through the evaporator coil 13 across the plenum 21, through the blower housing 18 and out the cabinet. In this way, during operation of the blower mechanism, a negative pressure condition is created within the plenum 21. As will be described hereinbelow, this negative pressure can have an adverse effect on the proper drainage of condensate from the condensate pan 14.

Connected to and leading from the condensate pan 14 is a condensate drain tube 22 which extends across the bottom surface of the cabinet 11 and through the wall 23. The drain tube 22 is typically composed of an elastomeric material and rests next to but outside of the blower housing 18. Connected to the outer end of the drain tube 22 is a P-trap 24 which functions in a conventional manner to maintain condensate in the lower portion thereof to provide a seal against the flow of air back into the system.

Figure 2:
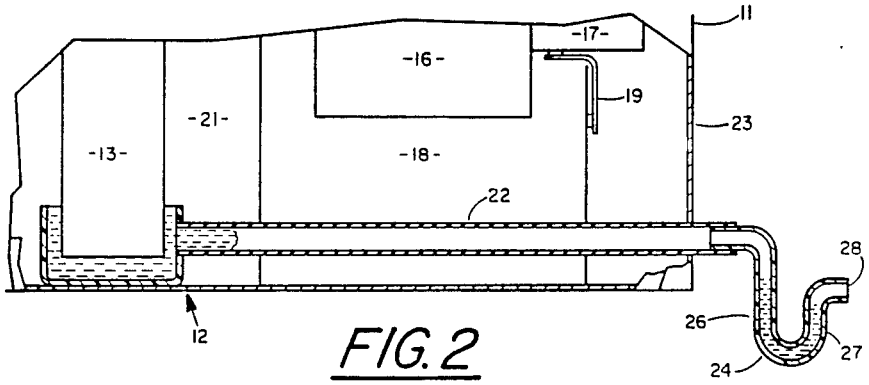
FIG. 2 is a view thereof showing the drainage water in the blocked condition.
Figure 3:
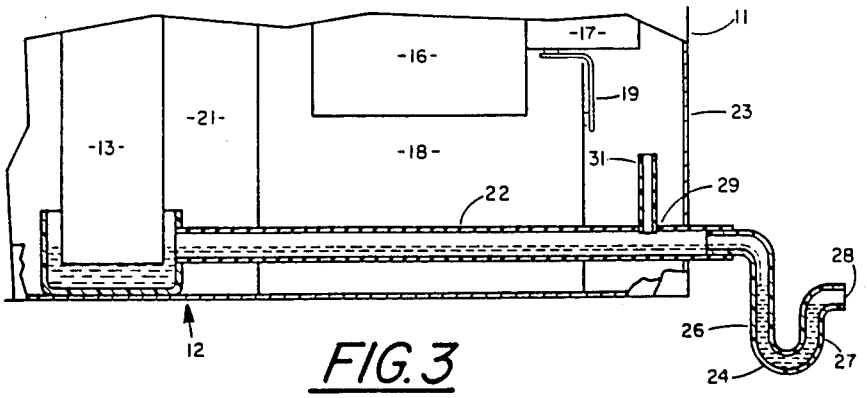
FIG. 3 is a view thereof with the vent installed in the drainage conduit in accordance with the present invention.

In the normal operation of the drainage system 12 as showr in FIG. 1, the level of the condensate builds up in the condensate pan 14 until it reaches the lower wall of the drain tube 22, at which time it begins to flow through the drain tube 22 to the trap 24. In the meantime, the water level within the P-trap 24 is such that the level on the trap inner side 26 is at a higher level than that on the trap outer side 27, with the difference being caused by the negative pressure with the plenum 21. As the condensate from the drain tube 22 raises the level of the water in the trap inner side 26 to the point where the head overcomes the differential pressure across the trap 24, the condensate is then caused to flow through the trap and out the discharge end 28. Because of certain phenomenon discussed hereinabove, it has been found that the condensate does not always freely flow through the drain tube 22, but rather tends to build up on the left side thereof as shown in FIG. 2. If this occurs, the condensate pan 14 eventually fills up and overflows to cause damage to the surrounding area.

The applicants have determined that the above-mentioned problem can be caused by a buildup of air pressure within the drain tube 22 to thereby prevent the flow of condensate within the tube 22. The applicants have solved this problem by the introduction of an air vent 29 and an associated riser tube 31 in the upper portion of the condensate drain tube 22 in such a way that the internal portion of the drain tube 22 is vented to the negative pressure area of the plenum 21. In this way, a slight vacuum is created within the drain tube 22 such that the air pressure therein is not able to build up to thereby prevent the flow of condensate.

The air vent riser tube 31 is preferably composed of a material which does not rust, but one which is not easily deformed to thereby cause a restriction in flow. A suitable material has been found to be copper. The position of the air vent riser tube 31 is preferably as close to the cabinet wall 23 as possible so that its effectiveness can be maximized. The particular length of the vent riser tube 31 is not critical. In fact, it may be satisfactory to simply provide the vent hole 29 formed in the upper surface of the drain tube to provide free communication for the flow of air between the inner portion of the tube and the plenum 21. However, in order to maintain an open vent in the elastomeric material it is preferred that the vent riser tube 31 be provided, with its length being such that its upper end extends to a level above that of the top surface of the condensate pan 14 as shown. Such a vent riser tube also serves as a position indicator to ensure that the hole is oriented upwardly during the assembly process. In addition, a riser will prevent any overflow that may tend to occur when the fan is turned off to thereby equalize the air pressure between the plenum and the ambient, at which time a greater volume of water suddenly tends to flow from the condensate pan to the drain tube 22. Also, if the system should become inoperable and an overflow occurs, the overflow will occur at the condensate pan 14 rather than at the tube 31.

It will be understood that the present invention has been described in terms of a preferred embodiment but may take on any number of other forms while remaining within the scope and intent of the invention.

What is claimed is:

1. A condensate disposal apparatus for an air conditioning system of the type having a fan for creating a zone of negative pressure and a coil located in said zone and being susceptible to the formation of condensate on its outer surface; comprising:

a condensate pan disposed below the coil for collecting the condensate as it falls from the coil, said pan having a discharge opening for the flow of condensate from said pan;

a condensate tube fluidly connected to said discharge opening for further conducting the flow of condensate from the pan;

a trap fluidly connected at the other end of said condensate tube for disposing of the condensate from the tube while preventing the flow of air and in the opposite direction; and a vent formed in said condensate tube at a location within said negative pressure zone for bleeding off air which may be trapped therein and which would otherwise prevent the flow of condensate from the pan to the trap.

2. A condensate disposal apparatus as set forth in claim 1 wherein said vent is located near said trap.

3. A condensate disposal apparatus as set forth in claim 1 and including a riser tube connected to said vent and extending upwardly from said condensate tube.

4. An improved condensate tube for interconnecting a condensate pan and a trap in an air conditioning system of the type having a fan for creating a negative pressure zone and a coil located in the zone and over the condensate pan, said condensate tube being susceptible to having a volume of air constrained therein between the trap on one end thereof and the flow of condensate from the pan on the other end thereof; comprising:

a vent formed in said tube at a location within said negative pressure zone for bleeding off the constrained air to the negative pressure zone.

5. An improved condensate tube as set forth in claim 4 wherein said vent is located near said trap.

6. An improved condensate tube as set forth in claim 4 and including a riser tube fluidly connected to said vent and extending upwardly from said condensate tube.

7. A condensate disposal apparatus as set forth in claim 1 wherein said condensate tube extends in a substantially horizontal disposition.

* * * * *